US011845098B2

(12) United States Patent
Pungetti et al.

(10) Patent No.: US 11,845,098 B2
(45) Date of Patent: Dec. 19, 2023

(54) CLEANING STATION FOR CLEANING THE SPRAYING GUNS IN A SPRAY BOOTH, AND METHOD

(71) Applicant: CEFLA Società Cooperativa, Imola (IT)

(72) Inventors: Cristian Pungetti, Imola (IT); Stefano Chiarini, Imola (IT); Marco Lombini, Imola (IT)

( * ) Notice: Subject to any disclaimer, the term of this patent is extended or adjusted under 35 U.S.C. 154(b) by 0 days.

(21) Appl. No.: 17/701,532

(22) Filed: Mar. 22, 2022

(65) Prior Publication Data

US 2022/0305514 A1 Sep. 29, 2022

(30) Foreign Application Priority Data

Mar. 29, 2021 (IT) ..... 102021000007592

(51) Int. Cl.

| | |
|---|---|
| ***B05B 16/20*** | (2018.01) |
| ***B05B 16/00*** | (2018.01) |
| ***B08B 1/00*** | (2006.01) |
| ***B08B 3/08*** | (2006.01) |
| ***B08B 13/00*** | (2006.01) |

(52) U.S. Cl.

CPC ..... *B05B 16/20* (2018.02); *B05B 16/90* (2018.02); *B08B 1/002* (2013.01); *B08B 3/08* (2013.01); *B08B 13/00* (2013.01)

(58) Field of Classification Search

CPC ..... B05B 16/20; B05B 16/90; B05B 13/0405; B05B 13/0468; B05B 15/555; B05B 15/52; B05B 16/95; B05B 16/00; B05B 15/50; B05B 15/55; B08B 1/002; B08B 3/08; B08B 13/00

See application file for complete search history.

(56) References Cited

U.S. PATENT DOCUMENTS

| | | | | |
|---|---|---|---|---|
| 5,107,876 | A * | 4/1992 | Ozyjiwsky | B08B 15/026 134/111 |
| 2003/0127046 | A1* | 7/2003 | Zehner | B08B 3/04 118/302 |
| 2012/0291819 | A1 | 11/2012 | Wakimoto | |
| 2017/0368579 | A1* | 12/2017 | Prus | B08B 3/08 |

FOREIGN PATENT DOCUMENTS

| | | |
|---|---|---|
| EP | 3263228 | 1/2018 |

OTHER PUBLICATIONS

Italian Patent and Trademark Office, Search Report, dated Nov. 22, 201(Relevant portions are in English).

* cited by examiner

*Primary Examiner* — Erin F Bergner
(74) *Attorney, Agent, or Firm* — Themis Law

(57) ABSTRACT

A spray booth for spraying pieces to be painted with a painting product includes a system that conveys the pieces to be painted inside the booth, a supplying circuit that supplies a painting product or solvent to painting tools, a plenum, a mobile wall providing access to the inside of the spray booth, optionally a reading system for the pieces to be painted, optionally a filtering system, a plurality of spraying tools that include one or more a spray guns each placed on an independent arm moving on a plane and optionally in a vertical direction, one or more cleaning stations, placed in correspondence of the mobile wall and provided with a drawer that is mobile between rest and a cleaning positions and that includes a painting product or solvent draining tube having a mouth, a slot for supplying compressed air, and a brush for brushing the spray guns.

10 Claims, 7 Drawing Sheets

CLEANING STATION FOR CLEANING THE SPRAYING GUNS IN A SPRAY BOOTH, AND METHOD

FIELD OF THE INVENTION

The present invention relates to the technical field of apparatuses for applying paint on mainly flat pieces such as panels and/or three-dimensional pieces, known in the art as spray booths. In particular, the present invention relates to a cleaning station for the cleaning and the color changing of spraying tools, said cleaning station being arranged adjacently to said spray booth.

BACKGROUND OF THE INVENTION

Mainly flat panels are panels, in which two of the three dimensions are bigger, by an order of magnitude, than the third dimension. Typically, said panels have measures ranging between 100×300×18 mm and 1250×2400×30 mm.

Three-dimensional pieces are pieces, in which the three dimensions of a piece are comparable. Indicatively, said three-dimensional pieces are provided with dimensions ranging between 200×400×100 mm and 1300×3000×200 mm.

In the art, spray booths are known, which typically are provided with a closed space (a booth), inside which the pieces to be painted are conveyed through a conveying system. Typically, said conveying system comprises at least two rollers, one of which is usually motorized while the other one is an idle roller, and a closed belt, on which the pieces to be painted lay. The conveying system can work so that the pieces are painted while passing (i.e., without stopping the closed belt) or intermittently.

It is worth mentioning that in the present invention said spray booth works preferably in an intermittent way: a payload (comprising one to some tens of pieces to be painted) is conveyed inside the spray booth; the conveying of pieces is stopped; the pieces are painted, and once the painting is completed, said pieces are conveyed out of the spray booth. A production batch, painted with a single painting product (a single color) ranges one payload to any number of payloads. Typically, the pieces to be painted are painted in production batches painted with the same color, e.g., blue. Subsequently, the spray booth must be cleaned to change color, e.g., to paint the successive batch with yellow. Alternatively, the pieces could be painted in continuous, without stopping the conveying of pieces.

It is known to provide said spray booths with reading systems of the pieces to be painted, a plenum, and air filtering systems. In this context, plenum means a ceiling able to distribute an airflow entering into the closed space of the booth while painting takes place. Fans force air into the booth, which can be adjusted in order to vary the speed and the quantity of air input into the spray booth in a time unit. The distribution of air must be as uniform as possible, while the speed of air must be controlled. In some points of the plenum the airflow can vary, while it must be constant over time in that specific point. The adjustment of inlet fans is intended to compensate the pressure drop, so that the distribution of air to said plenum is maintained inside optimal pre-set limits. Said plenum is in fluidic connection with a suction tower arranged on one of the sides of the spray booth.

Spray paint application entails that not all the sprayed paint hits the parts to be painted; the paint not hitting parts partly hits the conveying system, and partly hovers in the air inside the spray booth itself. This last portion of sprayed paint is called overspray, and is partially intercepted by a spray booth suction system, which can be, in a known way, of different kinds, and comprise or not a suction tower.

Finally, it is known to arrange said spray booth inside a production line, wherein a plurality of machines making different operation are placed in series upstream and downstream said spray booth. E.g., upstream said spray booth there may be provided a machine making a pre-treatment of the pieces to be painted, while downside said spray booth there may be provided a drying oven and/or a vertical storage.

Spray booths are known that through automatic devices (reciprocators, rotating spraying systems, gantry-robots, anthropomorphic-robots) spray paint on parts to be painted.

It is known to provide said spray booths with two spraying arms, each of which bears at least a spraying tool, e.g., in the form of known spraying guns. In this context it is worth specifying that according to the present invention said spraying tools are preferably Cartesian robots or anthropomorphic robots.

The current productive system is based on batch-and-queue production, and generates long lead times; moreover, it requires to produce panels in advance with respect to shipping. Even with the more accurate forecast, the emergency production of panels that are not in the finished goods warehouse is inevitably necessary, or alternatively obsolescence is generated when such warehouse inventories are dimensioned so as to have a greater safety margin.

All this is antithetic with the most modern techniques for organizing production, based on methods known as Toyota Production System (TPS) or Lean Production or Just in Time (JIT). Market drivers are: delivery speed and product customization, lead time reduction, reduced dimensions of production batches, developing and producing special pieces. The production for a more modern warehouse as performed up to now is possible just for non-customized product (mass production). The market requirement is to produce lots size one, with a huge range of finish and dimensions of the panels, and with pull manufacturing.

For mechanical processing the problem was tackled, and now there are provided sundry solutions on the market. For painting, the problem is more complex.

The set-up time of the painting machines, although was reduced to few minutes, inevitably is very expensive due to material waste and need of cleaning solvents (in addition to the purchase cost, there is also the disposal cost to be considered). Therefore, to reduce these costs, the production is scheduled according to daily shipping, grouping the panels to be produced as much as possible according to the kind of paint applied. Despite these methods, the number of paint changes in a working shift went from about some units to several tens.

CN111822210A of Fuzhou Zhibuqu Tech CO LTD, WO2019053590A1 of Carlisle Fluid Tech INC, WO2015010018A1 of Graco Minnesota INC describe cleaning systems for the lumen of tubings and color changes.

CN110605208A of Jiangsu Zonghu Coating Equipment Ind Res Inst CO LTD, DE202012104930U1 of Metso Paper INC, EP300248B2 of Uni Ram CORP describe cleaning systems for nozzles and spray guns.

CN106513217A of Shanghai Kafer Automation Equipment CO LTD, CN111632785A of Hefei Haoming Intelligent Tech CO LTD, CN106362898B of Qingdao Jinguanghong Intelligent Machinery Electronics CO LTD, CN107321538A of Shenzhen Taida Robot CO LTD describe automated cleaning systems.

SUMMARY OF THE INVENTION

The present invention aims to provide a spray booth allowing to perform color changing, while minimizing the downtimes due to color changes.

This object is achieved by an apparatus and a method having the features of the independent claims. Advantageous embodiments and refinements are specified in claims dependent thereon.

This object is achieved through a spray booth according to the present invention, which is provided with:

at least two arms provided with a spraying tool comprising a plurality of spray guns for applying paint on pieces; and at least one, preferably two, cleaning stations of the spraying tool, which cleaning stations are arranged outside said spray booth, said combination allowing the first spraying tool to be cleaned while the second spraying tool paints pieces and vice versa, so that color changing is performed in masked time, without downtime, i.e., without stopping the painting of pieces.

Said spray booth is provided with at least one cleaning station according to the present invention, which is provided with a substantial box-shape and arranged adjacent to the spray booth. The arrangement is such that it allows to access the suction tanks. Said cleaning station comprises:

a draining tube for collecting paint and solvent. Said tubing is provided with a mouth; said draining tube drains paint/solvent in a (not shown) barrel generally placed outside the cleaning station; said barrel is manually emptied by a human operator;

at least a slot supplying compressed air; and a cleaning brush.

Said devices are placed inside a mobile drawer provided with two positions:

a rest position, wherein said mobile drawer is inside the perimeter of the cleaning station;

a cleaning position, wherein said mobile drawer protrudes in the spray booth.

In a first preferred embodiment, the spray booth is provided with two arms, each carrying a spraying tool, and with two cleaning stations. In said embodiment, the two said cleaning stations can be arranged on the same side of the suction tower, or alternatively they can be arranged on the opposed side, called operator's side, of the spray booth.

In a second embodiment, the spray booth is provided with four arms, each carrying a spraying tool, and with four cleaning stations.

The method according to the present invention comprises the following steps:

a. Inserting the cleaning station drawer inside the spray booth;

b. Inserting the spraying tool provided with spray guns inside said drawer;

c. Draining the spray gun supply circuit which channels a first painting product, by positioning each spray gun in front of the mouth of the draining tube through an actuator;

d. Optionally, supplying a solvent to spraying guns, by positioning each spray gun in front of the mouth of the draining tube through an actuator;

e. External brushing of spray guns, in the form of dry brushing or wet brushing through said brush;

f. External blowing of the spraying tool through compressed air supplied through at least a slot;

g. Supplying a new painting product up to the spray guns; the spray guns are positioned in front of the draining tube in order to supply the new painting product up to the nozzle while they are open to allow the passage from the solvent/old painting product to the new painting product; the spraying tool is ready to resume painting;

h. Leaving of the spraying tool from the cleaning drawer;

i. Closing of the cleaning station, with the return of the drawer into the inside of the cleaning station.

It is worth specifying that in the case the two successive painting products are of similar colors and chemically compatible, e.g., two paints with a similar composition, the first of which is pale brown and the second dark brown, the step d) with the solvent can be omitted.

The first advantage of the present invention is due to the prevention of downtimes for color changing: this allows to maximize the working time of the spray booth wherein painting is performed, with an apparent economical advantage.

The second advantage of the present invention is the possibility of working on production batches as small as needed, and the possibility of using Just In Time production techniques, while minimizing the quantity of finished products in storage.

The third advantage of the present invention is that the cleaning stations are arranged adjacent to the mobile walls with which typically said spray booths are provided. This allows to use the cleaning stations according to the present invention even in spray booths already installed in production lines (retrofit).

The fourth advantage is that the present spray booth can be used for intermittent painting or in continuous painting.

BRIEF DESCRIPTION OF THE DRAWINGS

Additional advantages and properties of the present invention are disclosed in the following description, in which exemplary embodiments of the present invention are explained in detail on the basis of the drawings.

DETAILED DESCRIPTION OF EMBODIMENTS OF THE INVENTION

Figure 1:
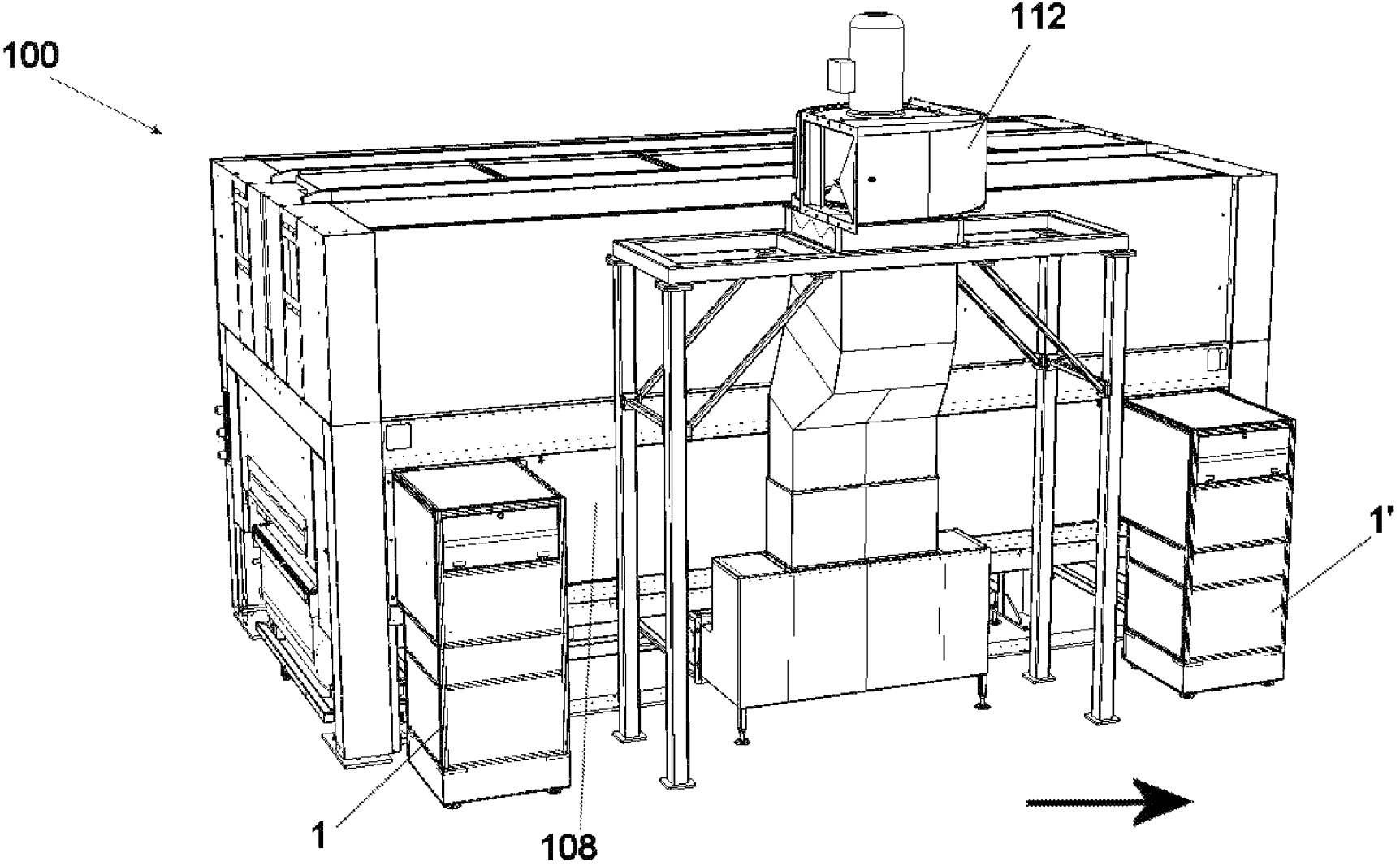
FIG. 1 is an axonometric view of a spray booth according to the invention from the side of the suction tower, provided with two cleaning stations.
Figure 6:
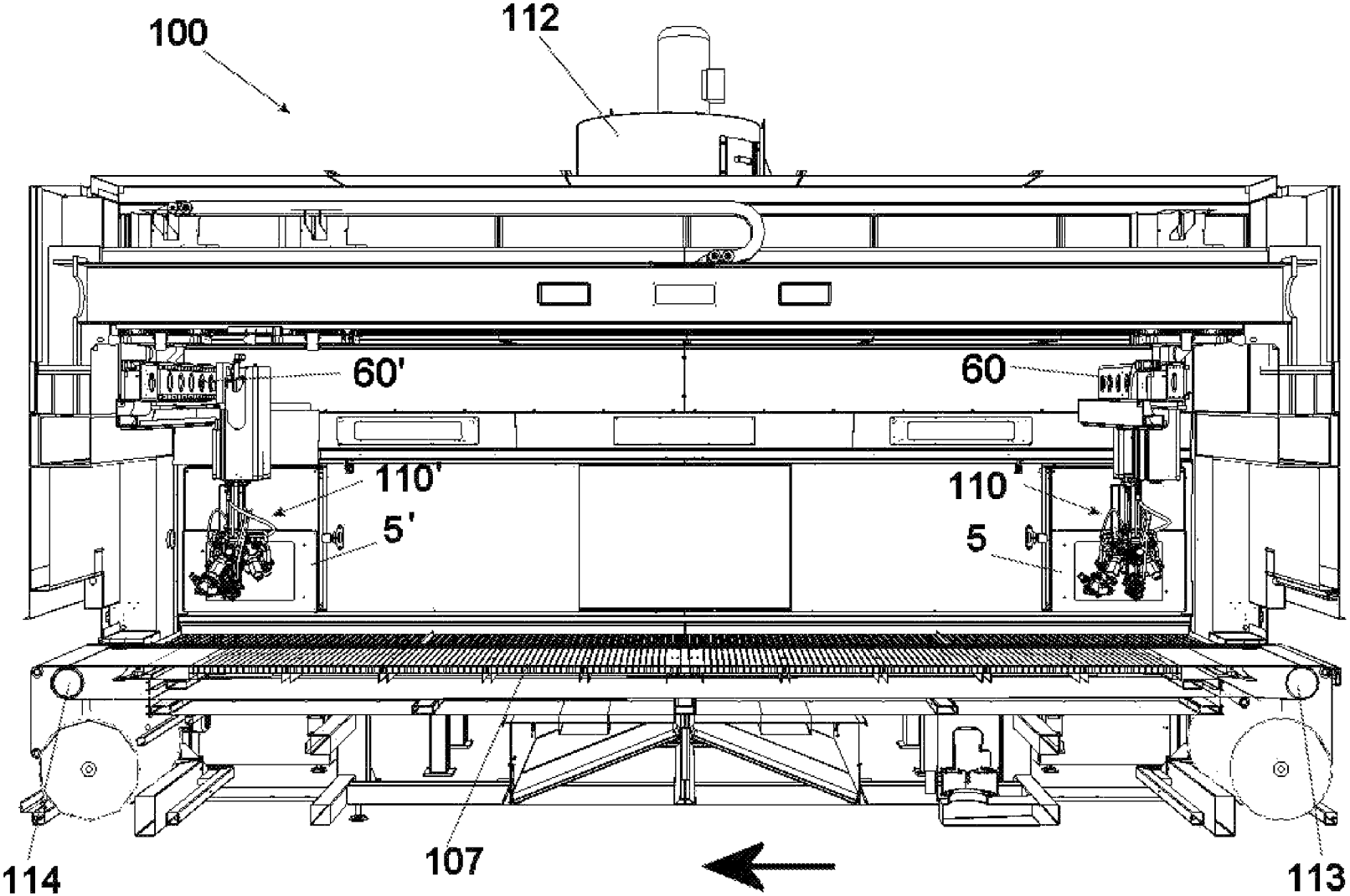
FIG. 6 is a longitudinal section of the spray booth with the spraying tools in the positions taken during cleaning.

FIG. 1 shows an axonometric view of a typical spray booth 100, in which mainly flat or three-dimensional pieces to be painted are conveyed through a closed band conveyer 107 (visible in FIG. 6). The bold arrow shows the conveying direction of the pieces to be painted. A suction tower 112 of known type is provided on the side visible in FIG. 1

A spray booth according to the invention is provided with two cleaning stations 1, 1', the first one being disposed on the ingress side of the pieces, and the second one on the egress side. The cleaning stations 1 are mobile, i.e., they can be connected to and disconnected from the spray booth for maintenance.

Figure 2:
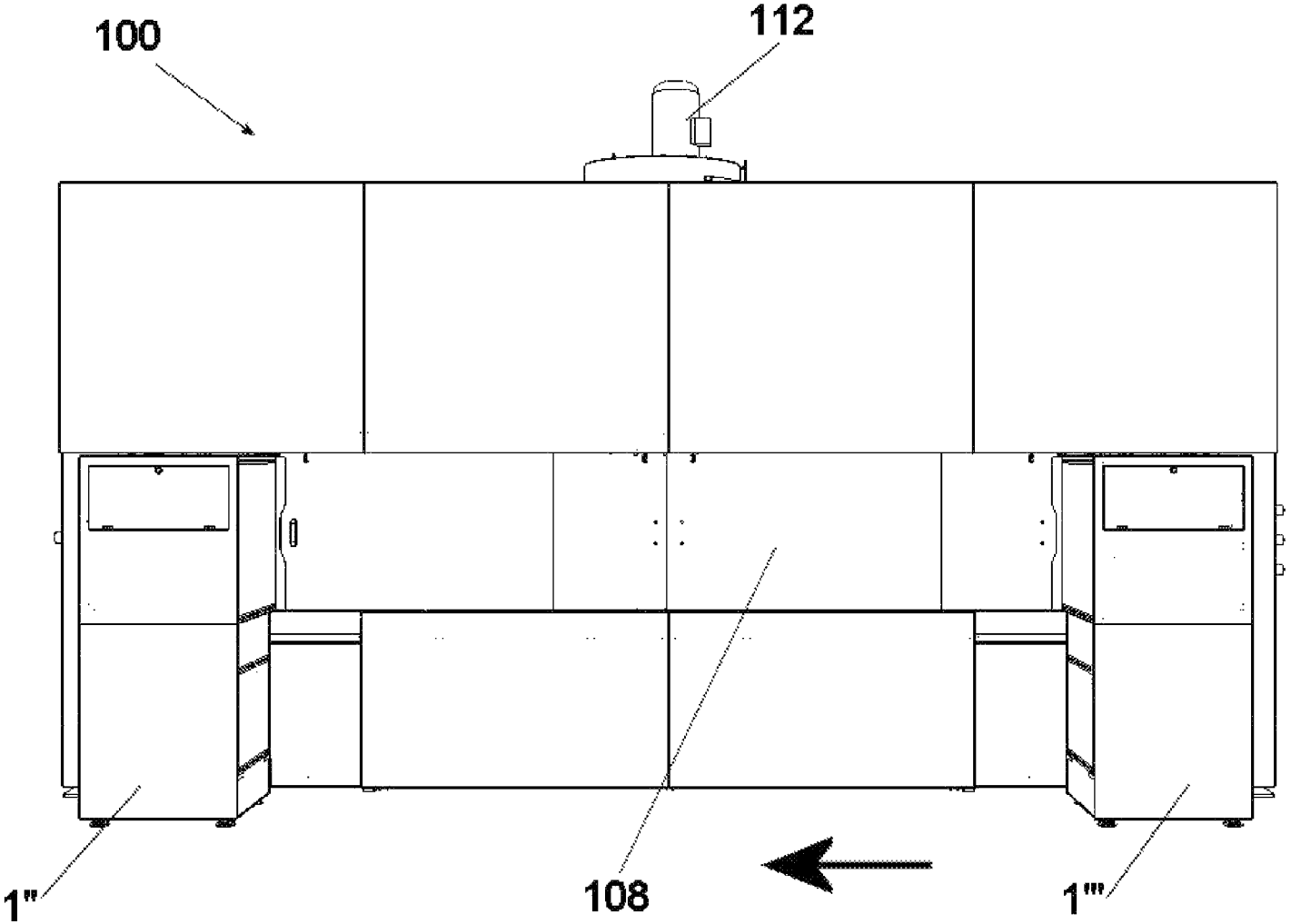
FIG. 2 is a side view of the spray booth from the operator's side, provided with two cleaning stations.

FIG. 2 shows a side view of a spray booth 100 according to the invention, in which two cleaning stations 1", 1''' are shown in their possible working position. FIG. 2 shows the positions of the cleaning stations 1", 1''' when said stations are used for cleaning spraying tools: they are placed on the side opposed to the suction tower 112, said opposed side being known as the operator's side. The bold arrow shows the conveying direction of the pieces to be painted.

FIGS. 1 and 2 also show the possible positions of the cleaning stations 1. As can be easily understood from FIGS. 1 and 2, when the cleaning stations 1 and 1' are placed on the same side as the suction tower, the footprint of the spray booth is reduced. Vice versa, placing the two cleaning stations 1", 1''' on the operator' side provides the human operator with an easier access to a barrel (not shown) collecting the drained solvent/paint pertaining to the cleaning station. Being able to place the cleaning stations on both sides of the spray booth provides the spray booth with great versatility, which facilitates integration into any production line.

It is known in the art to provide spray booths 100 with at least one mobile, transparent wall 108, which enables access to the inside of the spray booth. Said cleaning stations 1 are placed in a position adjacent to said spray booth, with their mobile portion (see below) placed in correspondence of said mobile wall 108. This allows providing even spray booth that are already installed in productive lines with at least one cleaning station according to the present invention as a retrofit.

The cleaning station 1 is tied to the spray booth 100 using fasteners such as screw). Moreover, the cleaning station 1, on the perimeter that comes into contact with the spray booth 100, is provided with suitable seals, e.g., made from polythene, which allow the sealing between said two components and prevents the dispersion of the overspray into the environment outside of the spray booth.

In a first, more common, embodiment, the spray booth is provided with two arms a spraying tool 10 being provided on each arm. Therefore, normally just two cleaning stations are provided on one of the two sides, two cleaning stations on the suction tower side, or alternatively two cleaning stations on the operator's side. In a second embodiment, said spray booth can be provided with four arms, a spraying tool being provided on each arm. Therefore, four cleaning stations are needed, two on the suction tower side and two on the operator's side.

Figure 3B:
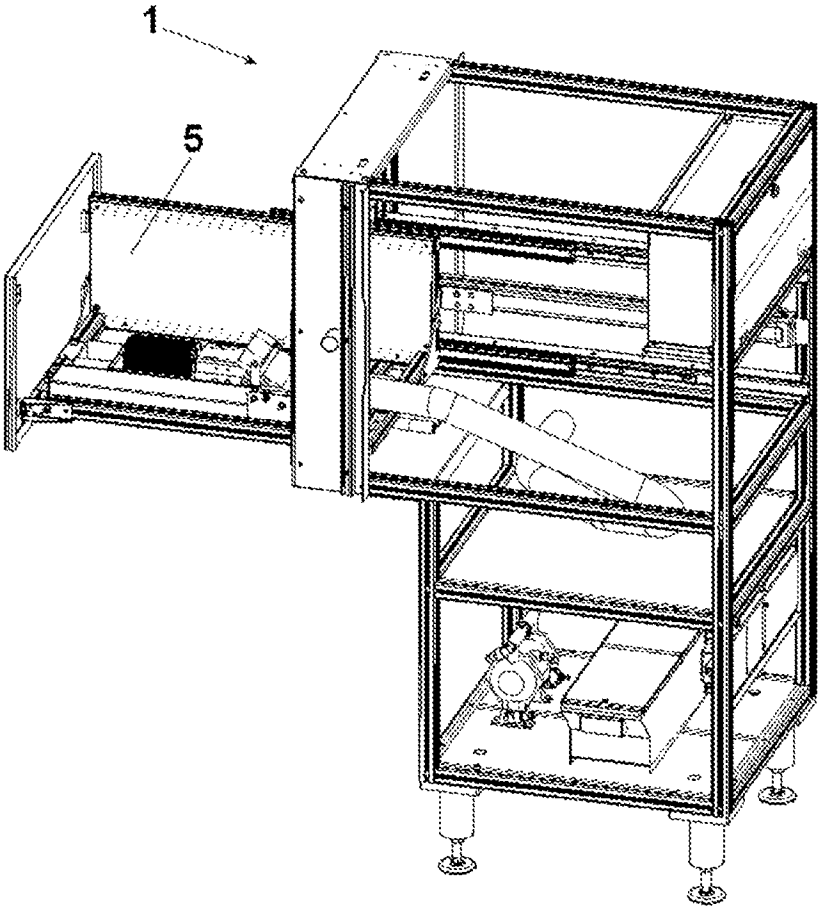
FIGS. 3A, 3B are axonometric views of the cleaning station separated from the spray booth, the first view being of the closed cleaning station and with its external housing and the second view being of the open cleaning station and deprived of its external housing.
Figure 3A:
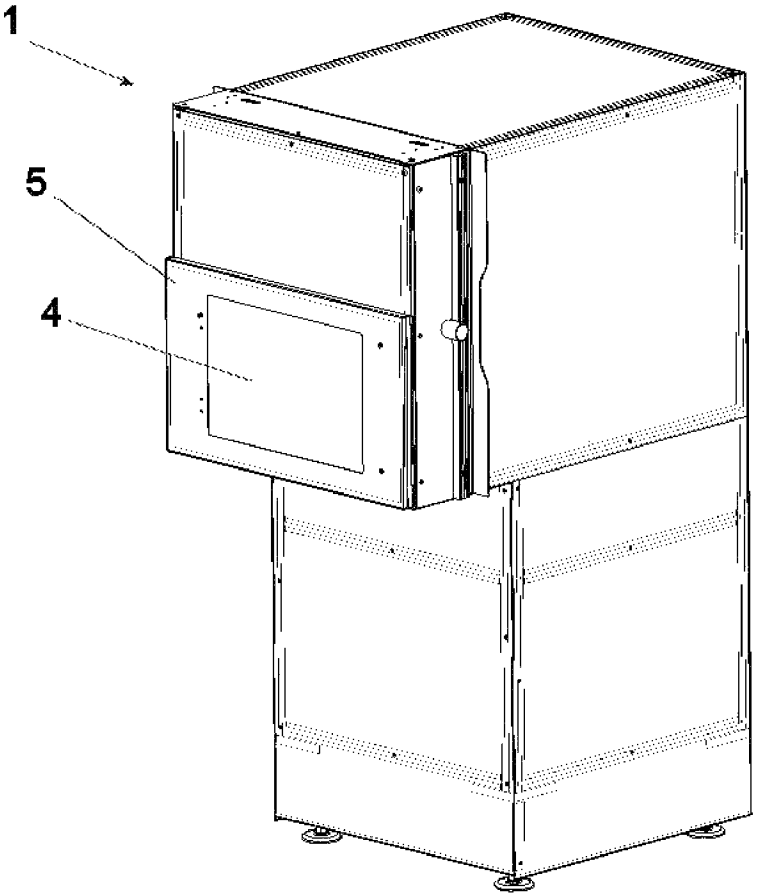

FIGS. 3A, 3B show said cleaning station 1 in two axonometric views, said cleaning station 1 being shown disassembled from the spray booth 100. In particular, FIG. 3A shows said cleaning station 1 with its external housing, with a closed cleaning drawer 5, in its rest position. FIG. 3B shows the same cleaning station 1 deprived of its external housing, with the drawer 5 in its opened position, defined as the cleaning position. When said drawer 5 is in its cleaning position, the portion of the drawer 5 protruding from the cleaning station is placed inside the spray booth 100.

Said drawer 5 is provided with a mobile protective wall 4, hinged and blocked with a magnet and a sensor, so that the spray booth 100 is stopped when the wall 4 is hit by the spraying tool. This is a safety mechanism: when the spraying tool 110 moves from its cleaning position toward the inside of the spray booth, generating a risk of collision, the painting is stopped.

Figure 4B:
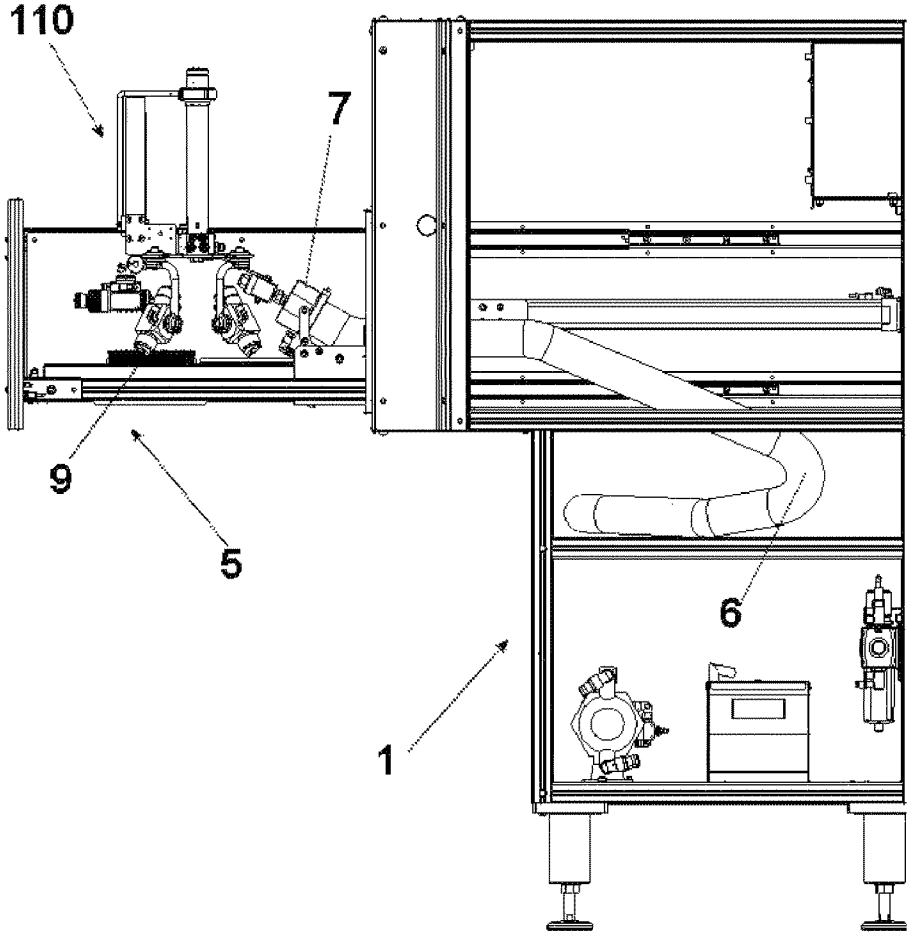
FIGS. 4A, 4B are a top view and side view of the cleaning station.
Figure 4A:
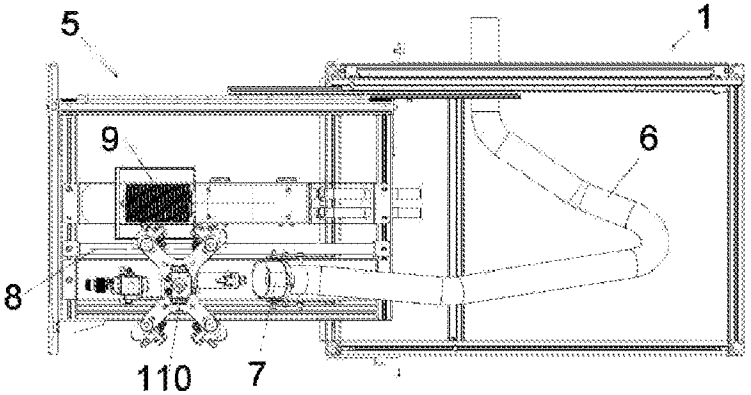

FIGS. 4A, 4B show said cleaning station 1 with the opened drawer 5, during one of the cleaning steps which will be explained below. In particular FIG. 4A shows the cleaning station in a top view, while FIG. 4B shows the same situation in a side view.

Said cleaning station 1 comprises:

A draining tube 6 for collecting painting products and solvents, provided with a mouth 7; said draining tube drains painting products/solvents in a (not shown) barrel generally placed outside the cleaning station. Said barrel is manually emptied by a human operator;

At least a slot 8 supplying compressed air;

A cleaning brush 9.

Said devices are meant for cleaning the spraying tools 110 with which the spray booth 100 is provided.

Figure 5B:
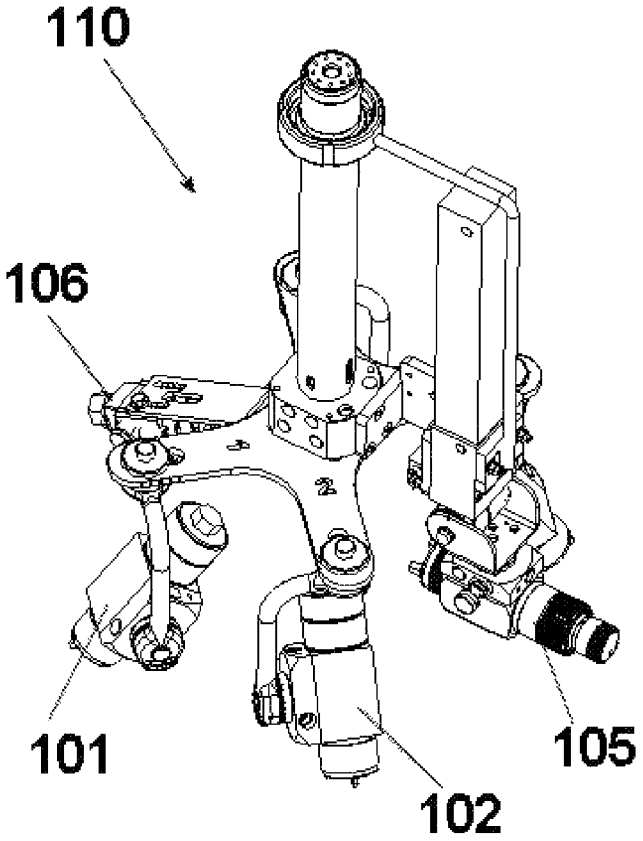
FIGS. 5A, 5B are a top view and axonometric view of the spraying tool.
Figure 5A:
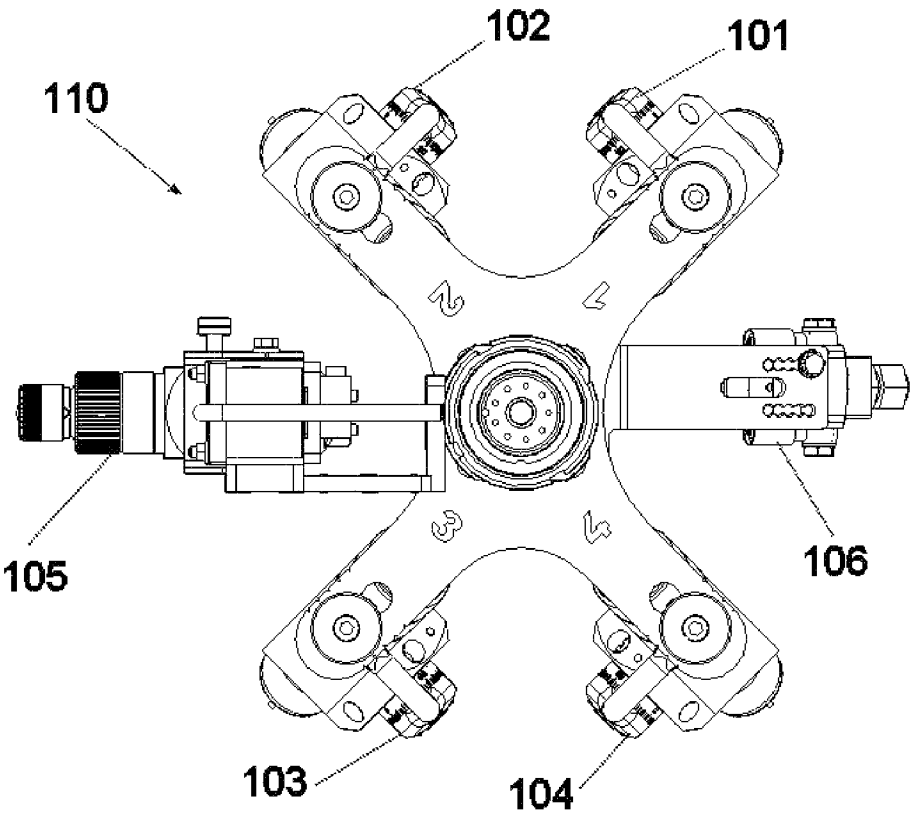

FIGS. 5A, 5B show said spraying tool 110 per se; in particular FIG. 5A shows a top view while FIG. 5B shows said spraying tool 110 in an axonometric view.

Said spraying tool 110 is provided with a supporting structure on which there are provided:

Four spray guns 101, 102, 103, 104 provided for painting the main surfaces of the pieces to be painted;

A spray gun 105 provided for the edges of the pieces to be painted;

An optional draining gun 106, whose function is draining more rapidly the tubings channeling the painting product/solvent to the spraying tool 110.

FIG. 6 shows a longitudinal section of the spray booth 100; the bold arrow shows the conveying direction of pieces to be painted (not shown). The Figure shows an idle roller 113 and a motorized roller 114 which rotate said closed band 107 on which the pieces to be painted are conveyed. Moreover, the Figure shows the arrangement of the two spraying tools 110, 110' in correspondence of the drawers 5, 5' of the cleaning stations 1, 1', respectively. In this case, the cleaning stations 1, 1' are arranged on the suction tower 112 side. The two shown positions are the positions taken by the two spraying tools 110, 110' during cleaning operations. During painting, the two spraying tools 110, 110' can take any position that is more central with respect to those shown in FIG. 6. It is also worth underlying that in the normal working of the spray booth, only the first spraying tool, e.g., 110, is painting, while, the second spraying tool 110' is cleaning, and vice versa. Therefore, the spraying tool 110' is placed in the cleaning position shown in FIG. 6, while the spraying tool 110 is free to move over the pieces to be painted, supported by the closed band 107 for painting.

It is known that the spraying tools 110, 110' are provided with four degrees of freedom in their movement:

A longitudinal direction corresponding to the conveying direction of the pieces to be painted, thanks to the movement of arms 60, 60' on which spraying tools 110, 110' are supported;

A transversal direction, corresponding to the width of the spray booth 100, wherein the spraying tools 110, 110' move sliding on their respective arm 60, 60';

A vertical direction, wherein the spraying tools 110, 110' come closer/move away to the pieces to be painted;

Finally, the spraying tools 110, 110' pivot around their longitudinal axis.

Figure 7:
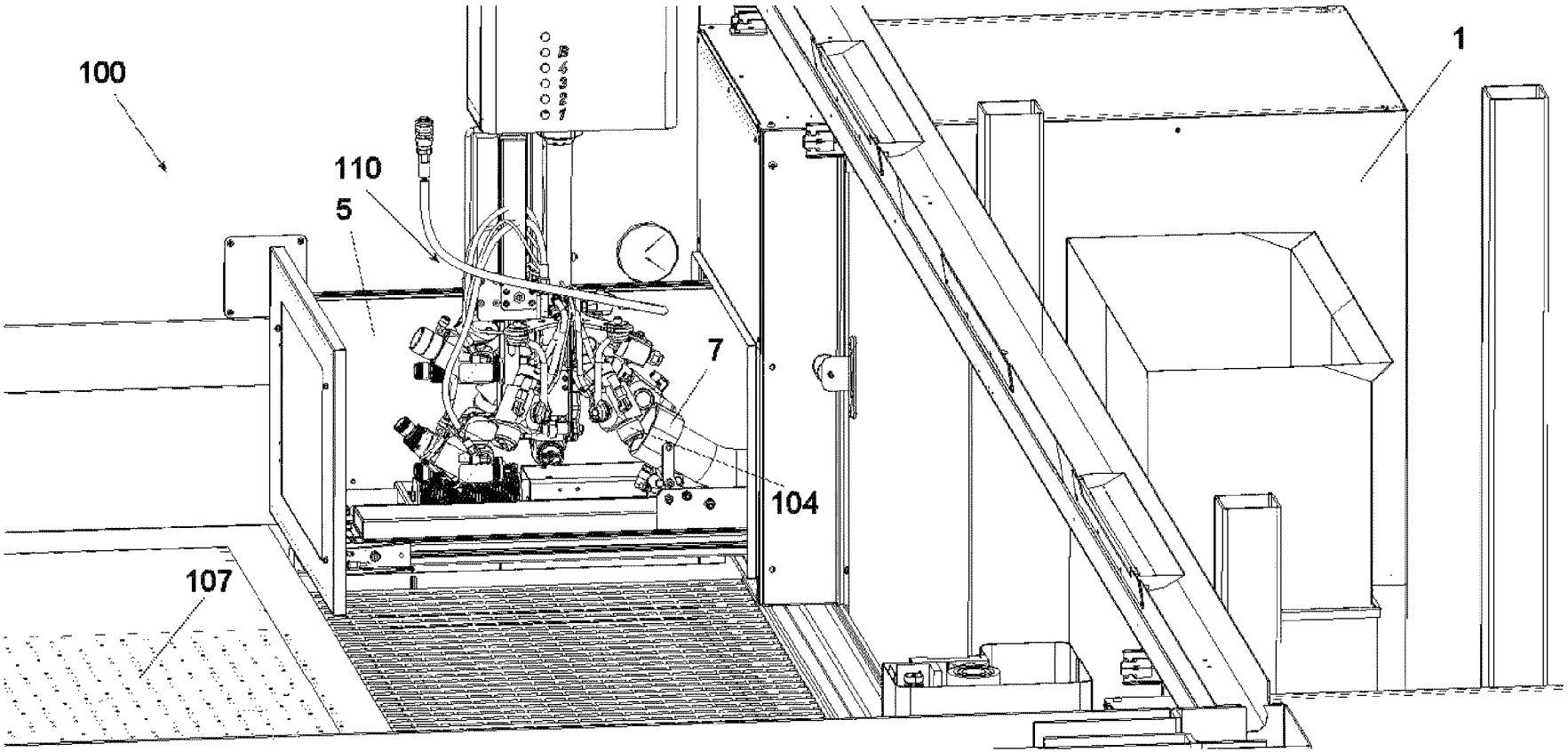
FIG. 7 is a side view of the drawer of the cleaning station during a cleaning operation.

FIG. 7 shows the inside of the spray booth in a side view. In the cleaning position, the drawer 5 of the cleaning station is extracted from the cleaning station 1 as shown in FIG. 4B, while protruding inside the spray booth 100. The Figure shows the draining tube 6 in a position adjacent to the spray gun 104; in particular the mouth of the tube 7 is placed so that it can collects the fluids (drained paint or solvent) which are drained from each spray gun 101-106 to be channeled into a (not shown) barrel.

In normal working, when one of the spraying tools must be cleaned e.g., 110, the drawer 5 is moved through its actuator and brought in its cleaning position wherein it protrudes in the spray booth, as shown in FIG. 7. The movement of the drawer can occur only if the arm 60 of the spraying tool is placed outside the opening area of the drawer 5, and moreover is in an area where interference with the arm 60' of the second spraying tool 110' is impossible. Now, firstly the arm 60 of the spraying tool to be cleaned moves in the conveying direction to approach the drawer 5; and secondly, the spraying tool 110 moves along its arm 60 to enter into the open drawer 5.

The method according to the present invention is applied to a spray booth 100 comprising preferably two cleaning stations 1, 1' placed indifferently on the suction tower side (FIG. 1) or on the operator's side (FIG. 2). It is also possible providing just one cleaning station 1 which is manually moved toward the ingress or the egress of the pieces to be painted, according to need. As already mentioned, the cleaning of one 110 of the two spraying tools is performed by the cleaning station 1 while the spraying tool 110' is spraying the pieces to be painted, moving freely inside the spray booth 100.

In different embodiments, a spray booth according to the invention optionally includes a reading system for the pieces to be painted and/or a filtering system.

Said method comprises the following steps:

a. Inserting the drawer 5 of the cleaning station 1 inside the spray booth 100 (cleaning position);

b. Inserting the spraying tool 110 provided with spray guns 101, 102, 103, 104, 105 and optionally with a draining gun 106 inside said drawer 5 of the cleaning station 1;

c. Draining the spray gun supply circuit which channels a first painting product; Obviously said spraying tools 110 are supplied by a (not shown) circuit supplying said painting product to the spraying tool 110, which circuit withdraws said painting product from a reservoir. In order to supply said spraying tools 100 with solvent, the painting product reservoir must be replaced with a solvent reservoir; such replacement can be made manually or automatically, see below;

d. Optionally, supplying a solvent to spraying guns 101, 102, 103, 104 provided for plane painting and to spraying gun 105 provided for painting edges. The guns 101, 102, 103, 104, 105 are placed one by one in front to the mouth 7 of the draining tube 6. In order to place the edge spray gun in front of the draining tube the tube 6 is to be moved through a pneumatic actuator;

e. External brushing of spray guns 101, 102, 103, 104, 105, through said brush 9;

f. External blowing of the spraying tool 110 through compressed air supplied through at least a slot 8. This step has the aim to dry the spraying tool 110 to prevent that drops of solvent or painting product remained on the outside of the spraying tool fall on the pieces to be painted;

g. Supplying a new painting product to spray guns (of a different color/composition with respect to the previous one) to spray guns 101, 102, 103, 104, 105. Spray guns are positioned in front of the mouth 7 of the draining tube 6 in order to supply the new painting product up to the nozzle while they are open to allow the passage from the solvent/old painting product to the new painting product; the spraying tool 110 is ready to resume painting;

h. Having the spraying tool 110 leave from the drawer 5 of the cleaning station 1;

i. Closing the cleaning station 1., and having the drawer 5 return into the inside of the cleaning station in the rest position shown in FIG. 3A.

The draining spray gun 106 is optional. When provided in the spraying tool 110, the draining steps of the old painting product, of the solvent and of the new painting product are faster. As spray gun 106 is not provided with a spraying nozzle, the diameter of the outlet hole is larger than that of the spraying guns, so as to allow a bigger flow rate than that of spray guns.

Supplying the subsequent product pushes the previous product out from the supplying circuit, for example, supplying the solvent pushes the old painting product out of the circuit, and the new painting product pushes the solvent out of the circuit. The changes are made upstream, manually replacing the supplying reservoir from which the pump draws, or automatically by using a known system for changing colors.

When two subsequent painting products are of similar colors and are chemically compatible, e.g., two paints have similar composition, the first one being pale brown and the second one being dark brown, the step d) with the solvent can be omitted.

The operation of the brush 9 for cleaning the outside of the spray guns may be different:

In a first case, the brush 9 is at least partially immersed in a small tank containing solvent, from which it is wetted. In this case, the supply of solvent, which is provided to the small tank through the same supplying circuit supplying the inside of spray guns, preferably occurs at a reduced pressure with respect to the normal supply pressure of the circuit of the painting product (e.g., 3 atmospheres in lieu of 100 atmospheres);

In a second case, the brush 9 dry-brushes the spray guns.

It should be noted that the cleaning of the outside of the spray guns is performed just for spray guns 101, 102, 103, 104, 105 and not for the draining gun 106.

The entire above-described method is automatic: the opening/closing of the drawer 5, the approaching of the mouth 7 of the draining tube 6 to one of the spray guns 101-106, the rotation of the spraying tool 110 to bring each spray gun in correspondence of the mouth 7, the replacement of the painting product or solvent to supply the supplying circuit of the spraying tool 110, the actuation of the brush 9, the supply of compressed air through at least one slot 8, are all performed by specific actuators, placed under the control of a PLC which is part of the spray booth 100.

In a completely automatic spray booth, there is provided a plurality of reservoirs containing different painting products and a plurality of pumps. When it is necessary to automatically pass to a different painting product (or to a solvent), changing color systems are used, i.e., systems provided with valves which can supply the supplying circuit of the spray booth by selecting from said plurality of reservoirs placed upstream the control valves. Such changing color systems are well known in the art.

As mentioned, the cleaning of one 110' of the two spraying tools is performed by the cleaning station 1' while the other spraying tool 110 is spraying the pieces to be painted, freely moving inside the spray booth 100. At the end of the method steps, the spraying tool 110 can start the cleaning steps according to the above-specified method, while the spraying tool 110' can start painting the subsequent payload of pieces to be painted. Basically, the cleaning operation on the first of the spraying tools 110, 110' occurs at the same time as the painting operation by the second spraying tool 110', 110. Consequently, no downtime is needed to clean the spraying tools, which occurs in masked time.

This way, the hourly productivity of the spray booth 100 is maximized, enabling work on production batches as small as needed. Potentially, every single payload can be painted with a different color.

LIST OF REFERENCE NUMBERS

1 cleaning station
4 mobile panel
5 drawer
6 draining tube
7 tube mouth
8 slot
9 brush
60 spraying tool arm
100 spray booth
101 spray gun
102 spray gun
103 spray gun
104 spray gun
105 spray gun
106 draining gun
107 closed band conveyor
108 transparent mobile wall
110 spraying tool
112 suction tower
113 idle roller
114 motorized roller

The invention claimed is:

1. A spray booth for spraying pieces to be painted with a painting product, comprising:

a system configured to convey said pieces to be painted inside side spray booth;

a supply circuit configured to supply a painting product or solvent to spraying tools;

a plenum;

a mobile wall allowing to access an inside of said spray booth;

optionally a reading system for the pieces to be painted, wherein the spraying tools comprise one or more spray guns, each of the spraying tools being placed on an independent arm moving on a plane and optionally in a vertical direction; and one or more cleaning stations placed in correspondence of said mobile wall, said one or more cleaning stations being each provided with a drawer that is mobile between a rest position and a cleaning position, said drawer comprising:

a draining tube of said painting product or solvent provided with a mouth;

a slot configured to supply compressed air; and a brush for brushing said one or more spray guns.

2. The spray booth according to claim 1, wherein each of said spraying tools further comprises a draining gun.

3. The spray booth according to claim 1, wherein said brush of each cleaning station is at least partially immersed in a tank containing solvent, by which said brush is wetted, said solvent being supplied by the supply circuit of the painting product or solvent; or wherein said brush performs a dry brushing of said one or more spray guns.

4. The spray booth according to claim 1, wherein said one or more cleaning stations are placed on a same side as the spray booth on which a suction tower is arranged, or alternatively said one or more cleaning stations are arranged on an operator's side.

5. The spray booth according to claim 1, wherein there are four spraying tools and four cleaning stations.

6. A method of cleaning spraying tools of a spray booth according to claim 1, the method comprising the following steps: Providing the spray booth according to claim 1 and performing the following steps with one of the one or more cleaning stations:

Inserting the drawer inside the spray booth;

Inserting one of the spraying tools provided with one or more spray guns inside said drawer;

Draining the supply circuit which channels a first painting product by positioning each spray gun in front of the mouth of the draining tube;

Optionally, supplying a solvent to one or more spraying guns, and optionally positioning each spray gun in front of the mouth of the draining tube;

Externally brushing said one or more spray guns by dry brushing or wet brushing with said brush;

Externally blowing the one of the spraying tools with compressed air supplied through said slot;

Supplying a new painting product up to the one or more spray guns, so that the one of the spraying tools is ready to resume painting;

Removing the one of the spraying tools from the drawer; and

Closing the cleaning stations with a return of the drawer into an inside of the cleaning station.

7. The method according to claim 6, wherein the method is performed with automatic steps, parts of the spraying booth being provided with actuators under control of a programmable logic controller (PLC), with which the spray booth is provided.

8. The method according to claim 6, wherein when said one of the spraying tools is provided with a respective draining gun, the painting product and the solvent being first drained with said draining gun.

9. The method according to claim 6, wherein when said brush is at least partially immersed in a small tank containing the solvent, the solvent being supplied through the supply circuit supplying an inside of the one or more spray guns.

10. The method according to claim 6, wherein the pieces to be painted are sprayed intermittently or in a continuous way.

* * * * *